US006170489B1

(12) United States Patent
Hoppe et al.

(10) Patent No.: US 6,170,489 B1
(45) Date of Patent: Jan. 9, 2001

(54) TOBACCO DISTRIBUTOR FOR CIGARETTE ROD MAKING MACHINE

(75) Inventors: Reinhard Hoppe, Tespe; Rolf Lindemann, Glinde; Peter Pinck, Hamburg, all of (DE)

(73) Assignee: Hauni Maschinenbau, Hamburg (DE)

( * ) Notice: Under 35 U.S.C. 154(b), the term of this patent shall be extended for 0 days.

(21) Appl. No.: 09/203,175

(22) Filed: Nov. 30, 1998

(30) Foreign Application Priority Data

Nov. 28, 1997 (DE) ..... 197 52 717

(51) Int. Cl.[7] ..... A24B 7/14; A24B 1/02; A24B 3/06

(52) U.S. Cl. ..... 131/109.1; 131/108; 131/109.3

(58) Field of Search ..... 131/108, 109.1, 131/109.2, 109.3, 110, 84.1, 84.2, 84.3, 321; 209/606

(56) References Cited

U.S. PATENT DOCUMENTS 2,166,022 7/1939 Repper .
3,276,452 10/1966 Dearsley .
4,681,124 7/1987 Hinzmann et al. .
5,009,238 4/1991 Heitmann .
5,511,566 4/1996 Brand .

FOREIGN PATENT DOCUMENTS 2 158 690 11/1985 (GB) .
477986 1/1998 (GB) .

*Primary Examiner*—James Derrington
*Assistant Examiner*—Dionne A. Walls
(74) *Attorney, Agent, or Firm*—Venable; George H. Spencer; Robert Kinberg

(57) ABSTRACT

The carding at the periphery of a driven wheel in the distributor of a cigarette rod making machine receives tobacco particles from the lower portion of a substantially upright duct the upper portion of which can receive tobacco particles from a magazine by way of an elevator conveyor. At least the lower portion of the duct is vibrated (e.g., at an amplitude of approximately 6 mm and at a frequency of 15–25 Hertz) in directions at right angles to the horizontal rotational axis of the wheel to thus enhance the homogeneousness of the carpet of particles being transported by the carding beyond the discharge end of the lower portion of the duct.

20 Claims, 4 Drawing Sheets

302
301
311
318
310
303
313
312
304
306
307

TOBACCO DISTRIBUTOR FOR CIGARETTE ROD MAKING MACHINE

CROSS-REFERENCE TO RELATED CASES

This application claims the priority of German patent application Serial No. 197 52 717.5 filed Nov. 28, 1997. The disclosure of the German patent application, as well as that of each patent mentioned in the specification of the present application, is incorporated herein by reference.

BACKGROUND OF THE INVENTION

The invention relates to improvements in rod making machines of the tobacco processing industry, and more particularly to improvements in distributors (also called hoppers) which are utilized in machines for the making of cigarette rods, cigar rods or other types of tobacco-containing rods (hereinafter referred to as cigarete rod making machines) to draw tobacco particles from a magazine and to convert the withdrawn particles into one or more homogeneous streams ready to be trimmed, locally densified and/or otherwise treated or processed prior to conversion into one or more rod-like fillers each of which is ready to be draped into a web of cigarette paper. The resulting cigarette rod(s) is(are) subdivided into plain cigarettes of unit length or multiple unit length.

A distributor normally comprises a magazine which can receive batches of tobacco particles from one or more pneumatic conveyors, at least one elevator conveyor which draws smaller accumulations or batches of particles from the magazine, and an upright duct having an open top for reception of tobacco particles from the elevator conveyor and an open bottom above the carding at the periphery of a driven wheel which receives a continuous carpet of tobacco particles and cooperates with a so-called picker roller to convert the carpet into a shower of tobacco particles. Such particles are intercepted by an endless conveyor which forms a stream ready to be converted into the rod-like filler of a continuous cigarette rod. The homogeneousness or lack of homogeneousness of the carpet of tobacco particles influences the quality of the ultimate products, such as plain cigarettes or filter cigarettes.

Commonly owned U.S. Pat. No. 5,009,238 granted Apr. 23, 1991 to Heitmann for "APPARATUS FOR SUPPLYING FIBROUS MATERIAL TO MACHINES FOR SIMULTANEOUSLY PRODUCING A PLURALITY OF CIGARETTE RODS" discloses a distributor for the simultaneous making of two tobacco rods. The patented distributor employs several gates which are set up to promote the homogeneousness of the tobacco streams formed by the distributor. More specifically, the distributor is designed to enable the duct to effect a more uniform distribution of tobacco particles at the outlet which, in turn, enables the carding of the driven wheel to accumulate a superior (gap-free) carpet of tobacco particles. Such carpet is thereupon processed to form a plurality of discrete streams.

Commonly owned U.S. Pat. No. 4,681,124 granted Jul. 21, 1987 to Hinzmann et al. for "APPARATUS FOR MANIPULATING PARTICLES OF TOBACCO OR FILTER MATERIAL" discloses a distributor with an upright duct the lower end of which includes oscillatable front and rear walls to thus enhance the quality of the carpet of tobacco particles being received and entrained by the carding at the periphery of the driven wheel beneath the duct. The front and rear walls of the lower end portion of the duct are oscillated in the direction of the axis of the rotary wheel.

British patent No. 477,986 (corresponding to U.S. Pat. No. 2,113,514 to Ruau) discloses a tobacco feeding apparatus wherein the carding of the rotary wheel receives tobacco particles from a duct having a bottom portion with a pair of parallel walls which are oscillatable toward and away from each other.

The aforedescribed proposals have been found to bring about some improvements in the consistency of the carpet which is being drawn by the carding of the rotary wheel. However, such undertakings cannot invariably ensure the making of a high-quality (gap-free) carpet which can be converted into one or more homogeneous tobacco streams.

OBJECTS OF THE INVENTION

An object of the invention is to provide a novel and improved distributor or hopper which can be utilized in a cigarette rod making machine to turn out a high-quality carpet of tobacco particles ready to be converted into one or more high-quality (homogeneous) tobacco streams.

Another object of the invention is to provide a novel and improved duct for use in the above outlined distributor as a superior substitute for conventional ducts.

A further object of the invention is to provide a novel and improved method of moving the duct relative to the carding of the rotary wheel in a distributor of the above outlined character.

An additional object of the invention is to provide a cigarette rod making machine which is constructed and assembled to turn out rod-shaped smokers' products of superior quality.

Still another object of the invention is to provide a novel and improved method of converting an accumulation of tobacco particles into one or more homogeneous tobacco streams.

A further object of the invention is to provide a novel and improved distributor which can be combined with or incorporated in existing cigarette rod making or analogous machines.

Another object of the invention is to provide a novel and improved connection between discrete constituents of a duct in the distributor of a cigarette rod making machine.

SUMMARY OF THE INVENTION

The invention is embodied in a distributor for particles of smokable material of the tobacco processing industry. The distributor comprises a duct having an article receiving inlet at a first level and a particle discharging outlet at a second level below the first level, a particle removing member (such as a driven roller or wheel) having a carding and being rotatable about a predetermined axis to thus advance the carding beneath and past the outlet of the duct, and means for oscillating at least the outlet of the duct in directions at least substantially transversely of the predetermined axis.

At least the inlet of the duct is or can be at least substantially vertical.

If the particle removing member is a roller or a wheel, the carding is carried by the periphery of such roller or wheel. The carding can include elongated projections (such as pins) which extend from the periphery of the roller or wheel and forwardly as seen in the direction of rotation of the roller or wheel.

The oscillating means can include means for moving the outlet back and forth along an at least substantially horizontal path; such path can be a straight path or an arcuate path.

The arrangement can be such that the inlet and the outlet of the duct are oscillatable in opposite directions about a common second axis which is located at a level between the first and second levels and is or can be at least substantially parallel to the predetermined axis. The inlet and the outlet of such duct can be rigidly connected to or of one piece with each other.

The duct can extend at least substantially radially of the predetermined axis.

Alternatively, the outlet of the duct can be located downstream of the apex of the aforementioned roller or wheel as seen in the direction of rotation of the particle removing member. It is often preferred to place the outlet into close or immediate proximity of the apex.

If the inlet is stationary, the inlet and the oscillatable outlet of the duct normally define a gap which is or can be at least partially closed or sealed by one or more shrouds or the like.

Furthermore, if the inlet is stationary, the oscillating means for the outlet can include means for moving the outlet back and forth along a path which has a trailing end and a leading end as seen in the direction of rotation of the particle removing member. The trailing end is or can be nearer to the predetermined axis than the leading end. Such path is or can be an at least substantially straight path.

The apparatus can further comprise means for oscillatably supporting the outlet of the duct; such supporting means can include one or more leaf springs. If the inlet of the duct is elongated, the leaf spring or springs can be inclined relative to such inlet.

For example, the oscillating means can be set up to oscillate the inlet and/or the outlet of the duct at a frequency of between about 15 and 25 Hertz, particularly in the range close to 23 Hertz. Furthermore, the oscillating means can be set up to oscillate the inlet and/or the outlet of the duct at an amplitude of approximately 6 mm.

The novel features which are considered as characteristic of the invention are set forth in particular in the appended claims. The improved distributor itself, however, both as to its construction and the modes of assembling and operating the same, together with numerous additional important features and advantages thereof, will be best understood upon perusal of the following detailed description of certain presently preferred specific embodiments with reference to the accompanying drawings.

DESCRIPTION OF PREFERRED EMBODIMENTS

Figure 1:
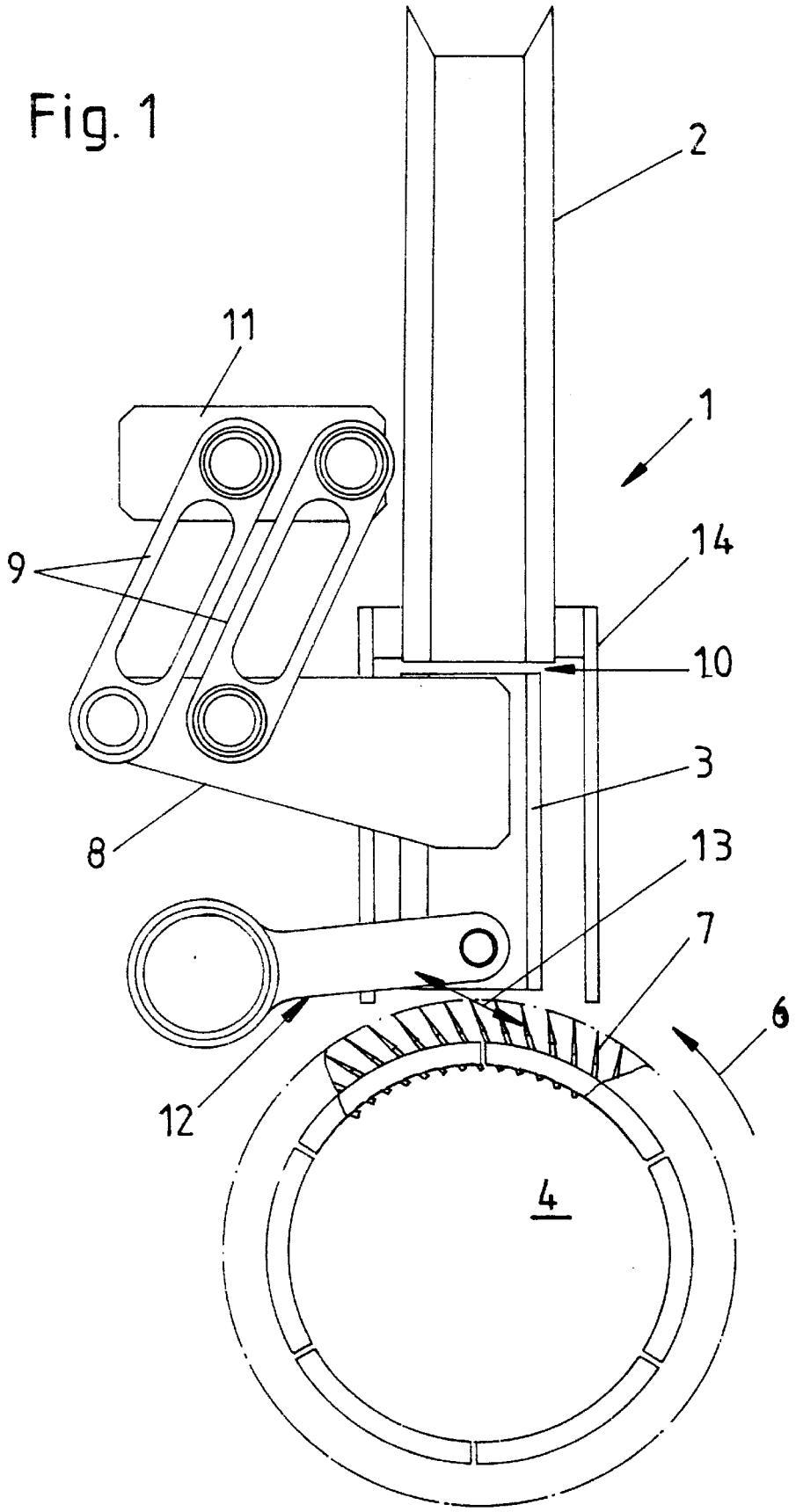
FIG. 1 is a fragmentary partly elevational and partly sectional view of a distributor which embodies one form of the invention and wherein the duct comprises a stationary inlet extending radially of the roller or wheel of the particle removing member.

FIG. 1 shows a portion of a distributor which can be put to use in a cigarette rod making machine to form one or more homogeneous streams of tobacco particles. The improved disrtributor comprises an upright duct 1 which extends at least substantially radially of a rotary motor-driven particle removing member 4 here shown as a roller or wheel rotatable about a horizontal axis and carrying at its periphery an annular carding 7. The carding 7 has pins, studs, needles or analogous protuberances or projections which are inclined forwardly as seen in the direction (arrow 6) of rotation of the member 4.

The duct 1 comprises a stationary upper portion or inlet 2 which is open at the top to receive tobacco particles from a suitable source by way of a suitable conveyor (e.g., from a magazine (1) by way of an elevator conveyor (13) shown in FIG. 1 of U.S. Pat. No. 5,009,238). The inlet 2 discharges tobacco particles into the lower portion or outlet 3 of the duct 1. In accordance with a feature of the invention, the outlet 3 is attached to one or more arms 8 of a linkage further including links 9 connecting the arm or arms 8 to a crosshead 11. Such mounting enables the outlet 3 to perform vibratory or oscillatory movements along a straight or substantially straight path (denoted by a double-headed arrow 13) having a trailing end and a leading end (as seen in the direction of the arrow 6). The trailing end is nearer to and the leading end is more distant from the axis of the rotary member 4.

The means for oscillating the outlet 3 of the duct 1 comprises at least one connecting rod 12 which is driven by a prime mover (such as an electric motor) by way of a rotary eccentric or the like.

In view of the illustrated mode of movably suspending the outlet 3 on the crosshead 11 at a level below that of the inlet 2, the parts 2, 3 define (at least at times) a clearance or gap 10 which is preferably sealed by a suitable shroud 14 in the form of an upright is tube or conduit spacedly surrounding the discharge end of the inlet 2 and at least the major part of the outlet 3.

It will be seen that, in contrast to the teaching of U.S. Pat. No. 4,681,124, the outlet 3 of the duct 1 is oscillatable transversely of the rotational axis of the member 4 and its annular carding 7. Such mode of agitating the outlet 3 enables the parts 3 and 7 to form an uninterrupted carpet of tobacco particles which is carried by the protuberances of the carding into the range of one or more suitable expelling members (such the picker roller 22 shown in FIG. 1 of U.S. Pat. No. 5,009,238). The picker roller(s) converts or convert the carpet into one or more homogeneous streams of tobacco particles, and each such stream is converted into the rod-like filler of a cigarette rod in a manner not forming part of the present invention.

The shroud 14 (which is or which can be affixed to the stationary inlet 2 of the duct 1) constitutes but one of various means for intercepting tobacco particles which tend to escape through the gap 10 when the oscillating means including the connecting rod 12 is in the process of moving the outlet 3 back and forth along the path indicated by the double-headed arrow 13. Such shroud can intercept particles of dust as well as larger particles of tobacco leaves; this reduces the likelihood of contamination of the area around the improved distributor and entails savings in tobacco.

An important advantage of the improved distributor and of its duct 1 is that, even if the column of tobacco particles in the duct is relatively high, such column is free to "breathe" due to the fact that the top of the inlet 2 is open and that the inlet 2 and outlet 3 define the aforementioned gap 14. Such "breathing" is caused by the oscillatory movements of the outlet 3 along the path 13, i.e., transversely of the axis of the rotary member 4, upwardly during forward movement (arrow 6) and downwardly during return or rearward movement counter to the direction indicated by the arrow 6. The result is the establishment and the maintenance of a fluidized bed of tobacco particles in the region beneath the open lower end of the outlet 3, i.e., in the region (at the apex of the rotary member 4) where the particles of such fluidized bed are engaged and entrained by the protuberances of the continuously advancing carding 7. The thus obtained carpet has been found to be free of gaps, of denser and less dense portions and/or of thicker and thinner portions all of which are important prerequisites for the making of cigarettes with highly satisfactory fillers. This brings about substantial savings in tobacco and enhances the quality of the ultimate products. It is desirable to ensure that the actual weight of each of a short or long series of cigarettes matches or at least closely approximates an optimum weight. The same holds true for the density (and hence the so-called fullness) of tobacco fillers in the cigarettes. All in all, the improved distributor renders it possible to reduce the number of rejects.

Figure 2:
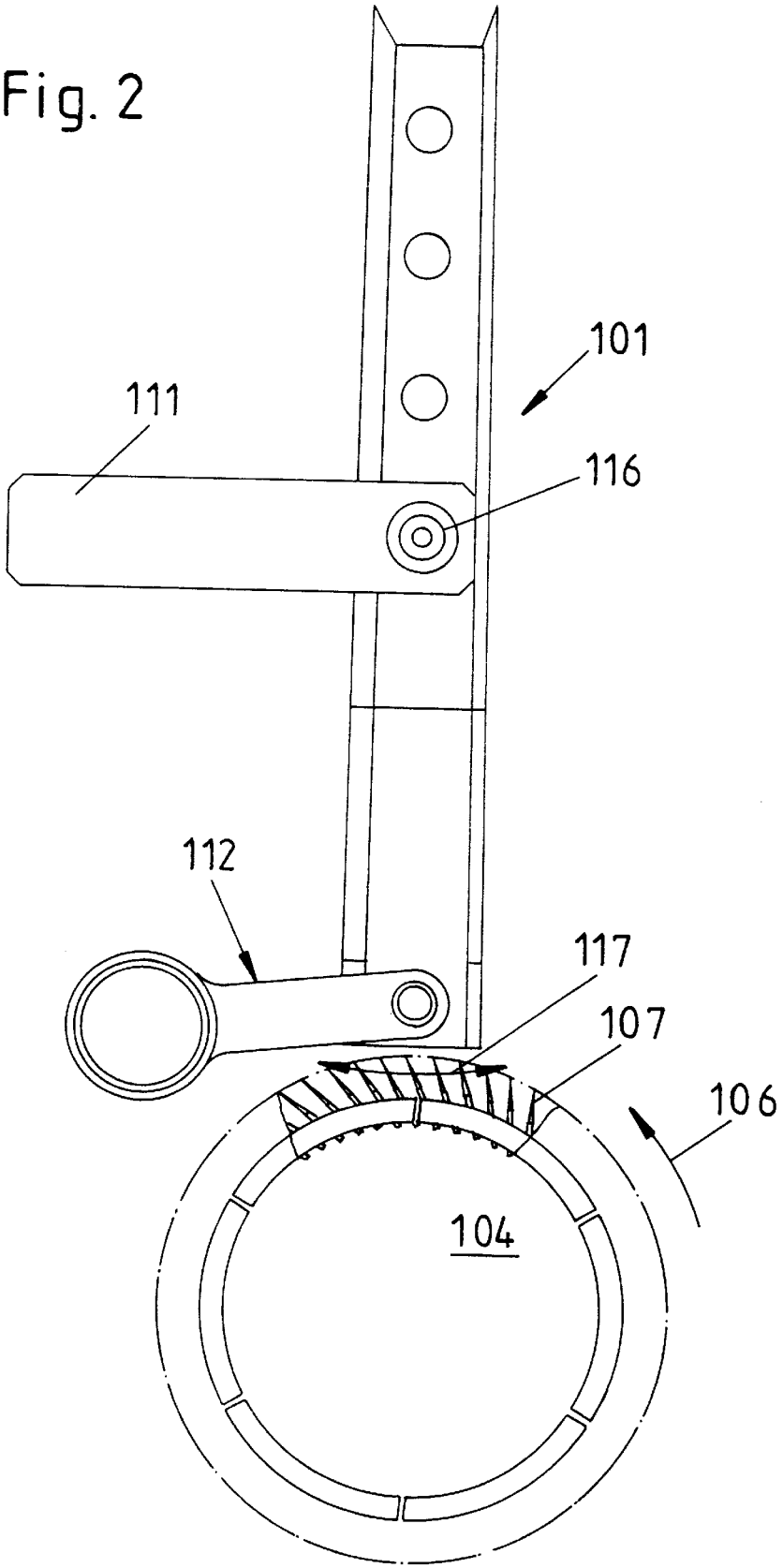
FIG. 2 is a similar view of a portion of a modified distributor wherein the inlet of the duct is rigid with the outlet and the entire duct is oscillatable about an axis which is parallel to the axis of rotation of the particle removing member.

FIG. 2 shows a portion of a modified distributor. All such parts of this distributor which are identical with or clearly analogous to the corresponding parts of the distributor embodying the structure of FIG. 1 are denoted by similar reference characters plus 100.

The duct 101 comprises an upper portion or inlet which is rigidly connected to or is of one piece with the lower portion or outlet. The entire duct 101 is oscillatable by a device including a connecting rod 112 so that the inlet and the outlet oscillate in opposite directions about a horizontal axis (defined by a pivot member 116 carried by a crosshead 111 or an analogous support) which is parallel to the rotational axis of the particle removing member 104. The latter is driven to rotate in the direction indicated by the arrow 106. The carding 107 receives tobacco particles from a fluidized bed of such particles at the lower end of the outlet of the duct 101. Such lower end is caused to oscillate along an at least substantially horizontal but slightly arcuate path (denoted by the double-headed arrow 117) having its center of curvature on the axis of the pivot member 116.

An advantage of the structure which is shown in FIG. 2 is its simplicity. Moreover, the mass of the upper portion of the duct 101 balances the mass of the lower portion of such duct.

Figure 3:
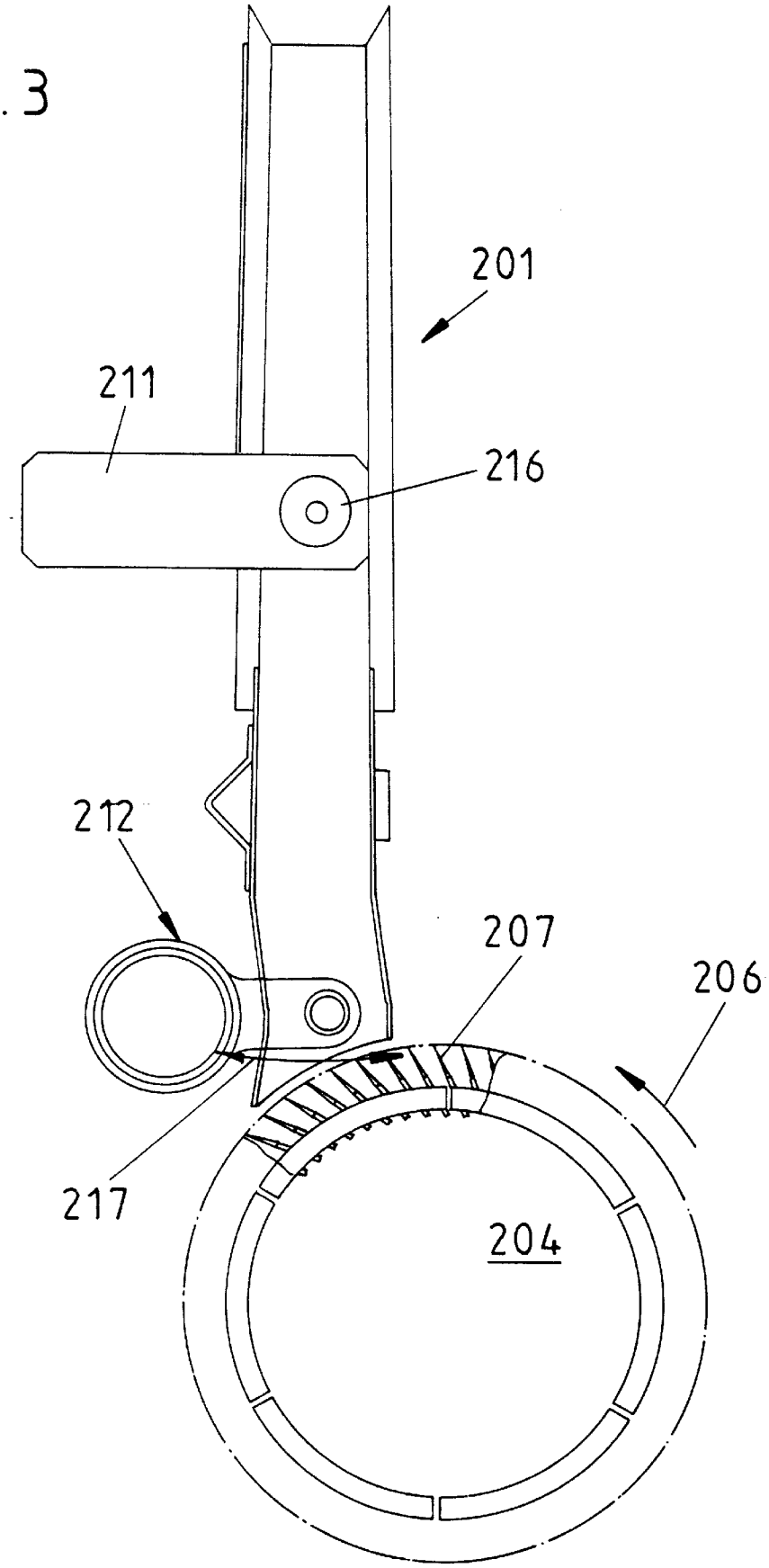
FIG. 3 is a similar view od a portion of a third distributor wherein the outlet of the duct discharges tobacco particles downstream of the apex of the ring-shaped carding as seen in the direction of rotation of the particle removing member.

All such parts of a third distributor or hopper shown in FIG. 3 which are identical with or clearly analogous to those of the distributor shown in FIG. 1 are denoted by similar reference characters plus 200.

The duct 201 is or can be rigid and is oscillatable about the horizontal axis of a pivot member 216 carried by a support 211 (e.g., a stationary frame member). The connecting rod 212 is arranged to oscillate the outlet of the duct 201 along a substantially horizontal but slightly arcuate path denoted by the arrow 217. The discharge end of the outlet of the duct 201 is located slightly downstream of the apex of the annular carding 207 at the periphery of the rotary particle removing member 204. The latter is driven to rotate in a counterclockwise direction (arrow 206). The discharge end of the duct 201 is bounded by a concave surface which is or can be at least substantially complementary to the convex (cylindrical) surface of the adjacent portion of the carding 207.

An advantage of the distributor including the structure of FIG. 3 is that the carding 207 is even more likely to gather and to entrain a uniform carpet of tobacco particles. This is attributable, at least in part, to the aforementioned configuration of the surface at the discharge end of the lower portion of the duct 201.

Figure 4:
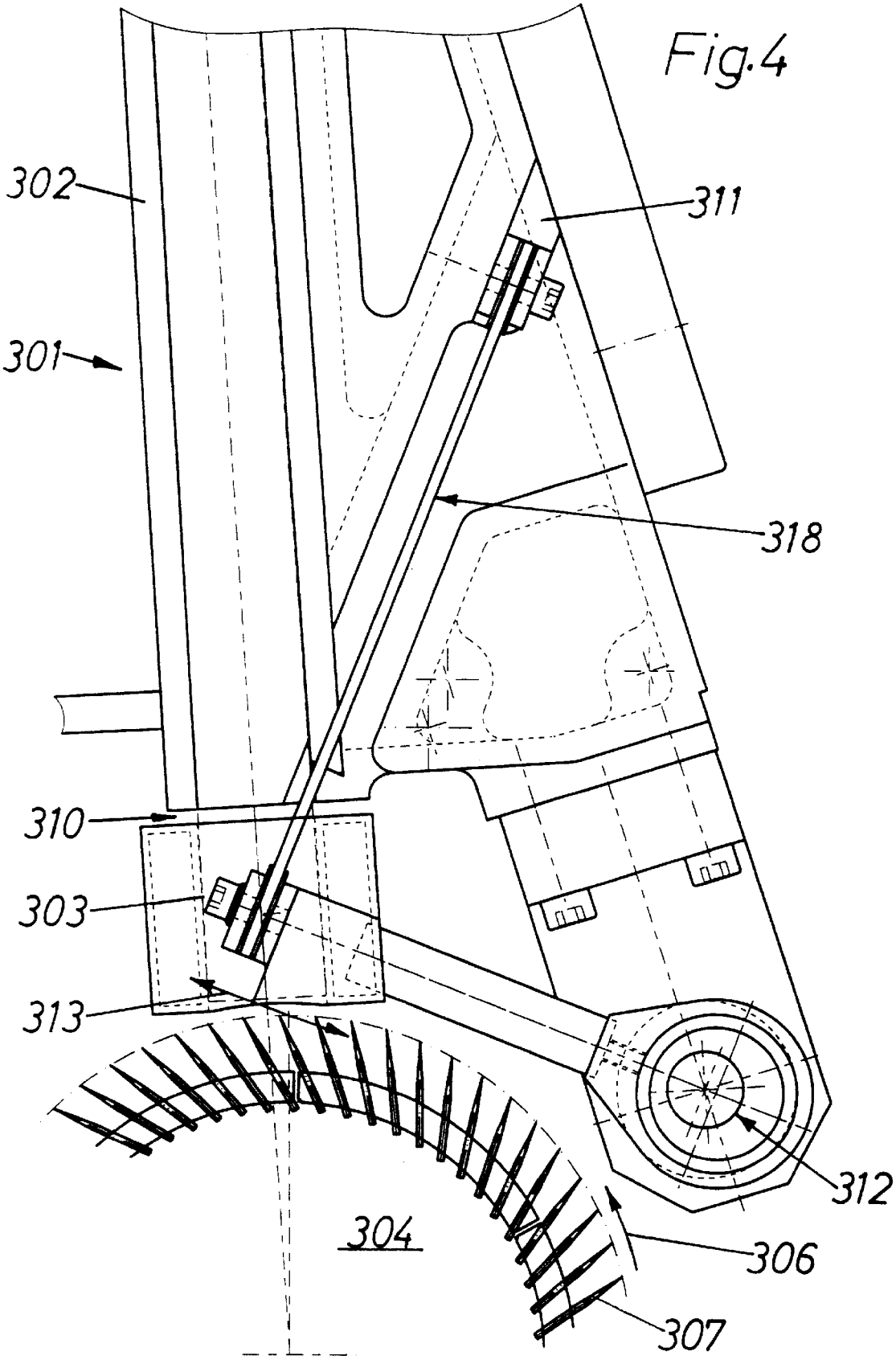
FIG. 4 is a fragmentary partly elevational and partly vertical sectional view of a distributor wherein the oscillatable outlet of the duct is carried by the lower end or ends of one or more leaf springs.

FIG. 4 shows a portion of a distributor or hopper which embodies still another form of the instant invention. All such parts of this distributor which are identical with or clearly analogous to those of the distributor shown in FIG. 1 are denoted by similar reference characters plus 300.

The duct 301 has an elongated upper portion or inlet 302 which extends radially of the rotational axis of the particle removing member 304 but is slightly inclined to the vertical. The lower portion or outlet 303 of the duct 301 is oscillatably supported by one or more leaf springs 318 affixed at 311 to the inlet 302 and/or to another stationary part. The illustrated leaf spring 318 and the elongated inlet 302 of the duct 301 make an acute angle.

The means for oscillating the outlet 303 of the duct 301 relative to the inlet 302 along a path 313 (similar to the path 13 in the distributor of FIG. 1) includes one or more connecting rods 312 or the like. The member 304 carries an annular carding 307 and is driven to rotate in a counterclockwise direction (arrow 306). The oscillating outlet 303 of the two-piece duct 301 actually urges particles of tobacco into the spaces between the protuberances of the carding 307 when it is moved to the right, as viewed in FIG. 4. The protuberances of the carding 307 are inclined forwardly as seen in the direction of the arrow 306, i.e., such protuberances do not extend exactly radially of the periphery of the rotary member 304.

An advantage of the relatively small outlet 303 is that the distributor of FIG. 4 generates little noise and that the outlet 303 can be oscillated by a drive whose energy requirements are minimal.

The height of the outlet 303 can be in the range of between about 50 and 70 mm. It has been found that a distrbutor embodying the structure of FIG. 4 and employing a duct 301 with an outlet 303 having a height of between 50 and 70 mm will operate very satisfactorily if the outlet 303 is oscillated at a frequency of between 15 and 25 Hertz (preferably at least close to 23 Hertz) and at an amplitude of approximately 6 mm. This results in the formation of a highly satisfactory carpet which is transported by the carding 307 beyond the outlet 303 and into the range of one or more picker rollers or other suitable shower forming means.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of tobacco distributors for cigarette rod making machines and, therefore, such adaptations should and are intended to be comprehended within the meaning and range of equivalence of the appended claims.

What is claimed is:

1. A distributor for particles of smokable material of the tobacco processing industry, comprising:

a duct having a stationary particle receiving inlet at a first level and an oscillating particle discharging outlet at a second level below said first level;

a particle removing member having a carding and being rotatable about a predetermined axis to thus advance said carding beneath and past the discharging outlet which is located directly above said particle removing member, said duct extending substantially radially from said axis of said particle removing member;

means for oscillating said outlet of said duct in directions substantially transversely of said axis; and means for oscillatably supporting said oscillating outlet of said duct.

2. The distributor of claim 1, wherein at least said inlet of said duct is at least substantially vertical.

3. The distributor of claim 2, wherein said particle removing member includes a roller having a periphery carrying said carding.

4. The distributor of claim 3, wherein said roller is rotatable in a predetermined direction and said carding includes elongated projections extending from the periphery of said roller and forwardly as seen in said predetermined direction.

5. The distributor of claim 1, wherein said means for oscillating includes means for moving said outlet back and forth along an at least substantially horizontal path.

6. The distributor of claim 1, wherein said axis is a substantially horizontal axis and said particle removing member is rotatable in a predetermined direction and has an apex above said axis, said outlet being located downstream of said apex as seen in said predetermined direction.

7. The distributor of claim 6, wherein said outlet is at least closely adjacent said apex.

8. The distributor of claim 1, wherein said particle removing member is rotatable in a predetermined direction and said oscillating means comprises means for moving said outlet back and forth along a path which has a trailing end and a leading end as seen in said predetermined direction, said trailing end being nearer to said axis than said leading end.

9. The distributor of claim 8, wherein said path is an at least substantially straight path.

10. The distributor of claim 1, wherein said supporting means comprises at least one leaf spring.

11. The distributor of claim 1, wherein said inlet of said duct is elongated and said at least one leaf spring is inclined relative to said elongated inlet.

12. The distributor of claim 1, wherein said oscillating means incudes means for oscillating said outlet at a frequency of between about 15 and 25 Hertz.

13. The distributor of claim 12, wherein said frequency is at least close to 23 Hertz.

14. The distributor of claim 1, wherein said oscillating means comprises means for oscillating said outlet at an amplitude of about 6 mm.

15. The distributor of claim 1, wherein said duct is substantially vertical throughout its length.

16. The distributor of claim 1, wherein said duct is substantially of a one-piece, unitary, vertical construction.

17. The distributor of claim 1, wherein said oscillating means is connected directly to the oscillating output of said duct.

18. A distributor for particles of smokable material of the tobacco processing industry, comprising:

a duct having a particle receiving inlet at a first level and a particle discharging outlet at a second level below said first level;

a particle removing member having a carding and being rotatable about a predetermined axis to thus advance said carding beneath and past said outlet; and means for oscillating at least said outlet of said duct in directions at least substantially transversely of said axis wherein said inlet and said outlet are oscillatable in opposite directions about a common second axis located at a level between said first and second levels.

19. The distributor of claim 18, wherein said second axis is at least substantially parallel to said predetermined axis.

20. A distributor for particles of smokable material of the tobacco processing industry, comprising:

a duct having a particle receiving inlet at a first level and a particle discharging outlet at a second level below said first level;

a particle removing member having a carding and being rotatable about a predetermined axis to thus advance said carding beneath and past said outlet;

means for oscillating at least said outlet of said duct in directions at least substantially transversely of said axis; and at least one shroud at least partially closing a gap occurring between said inlet and said outlet.

* * * * *